United States Patent [19]

Collins et al.

[11] 4,024,690

[45] May 24, 1977

[54] WINDOW SASH AND FRAME WITH THERMAL BARRIER

[75] Inventors: David R. Collins, Washington Crossing, Pa.; Sheldon N. Katz, Cherry Hill, N.J.

[73] Assignee: Replacement Products Industries Corporation, Cornwells Heights, Pa.

[22] Filed: Feb. 25, 1976

[21] Appl. No.: 661,199

[52] U.S. Cl. ..... 52/397; 52/402; 52/403; 52/616; 49/449

[51] Int. Cl.[2] ..... E04B 1/62; E05C 3/02

[58] Field of Search ..... 52/758 H, 475–477, 52/656, 730, 616, 397–399, 403, 127, 304; 403/292, 295, 231, 364; 49/450, 453, 449, DIG. 1; 85/DIG. 2

[56] References Cited

UNITED STATES PATENTS

| | | | |
|---|---|---|---|
| 1,857,294 | 5/1932 | Larson | 49/450 |
| 2,877,515 | 3/1959 | Haas | 52/398 |
| 2,965,935 | 12/1960 | Olsen | 403/295 |
| 3,131,440 | 5/1964 | Leeser | 52/127 |
| 3,205,630 | 9/1965 | Felix et al. | 52/476 |
| 3,335,524 | 8/1967 | Carson | 52/403 |
| 3,377,747 | 4/1968 | Donkin | 49/450 |
| 3,411,247 | 11/1968 | Fleming | 52/616 |
| 3,462,884 | 8/1969 | Bissoniere | 49/DIG. 1 |
| 3,474,587 | 10/1969 | Martin | 52/456 |
| 3,910,254 | 10/1975 | Morgan | 52/304 |

*Primary Examiner*—Price C. Faw, Jr.
*Assistant Examiner*—James L. Ridgell, Jr.
*Attorney, Agent, or Firm*—Seidel, Gonda & Goldhammer

[57] ABSTRACT

The window is comprised of upper and lower sashes. Each sash includes two panes of glass with an air space barrier therebetween. All metal members on one face of each sash are thermally and electrically insulated from corresponding members on the opposite face of each sash to thereby provide a complete thermal and electrical barrier between the indoor and outdoor faces of the sashes.

18 Claims, 16 Drawing Figures

WINDOW SASH AND FRAME WITH THERMAL BARRIER

BACKGROUND

A larger number of window constructions have been proposed heretofore. A typical window structure includes a window frame, and two sashes which are movable with respect to each other and the window frame.

It is known to provide a replacement sash having first and second panes of glass thermally insulated from one another by an air space. It is known as per U.S. Pats. Nos. 3,114,179 and 3,204,324 to prevent transfer of heat by way of conduction between metal members on opposite faces of the sash. However, the teachings in said patents did not provide a complete thermal break. Also, the windows in said patents do not mechanically connect the metal members by structure other than the thermal barrier.

The window of the present invention includes one or more sashes. Each sash includes a border defined by side members interconnected by a top member and a bottom member. Each border supports two panes of transparent material such as glass in a manner so that the panes are spaced apart by a dead air space. A thermal barrier strip is provided around the periphery of each pane and a juxtaposed surface of the sash border.

The sash has oppositely disposed major faces one of which is the indoor face and the other being the outdoor face. The sash border includes metal members on the outdoor face thereof and metal members on the indoor face thereof. A thermal barrier interconnects and thermally insulates the metal members on the outdoor face from corresponding metal members on the indoor face so that there is no direct heat conductive contact between the outdoor and indoor faces of the sash border. Non-metallic fasteners join each thermal barrier to juxtaposed surfaces of the metal members.

The complete thermal insulation of metal members on the outdoor face of the sash from metal members on the indoor face of the sash supplements the thermal barrier by the spaced panes of transparent material to thereby provide a completely thermally insulated window sash. The thermal barrier strips are preferably of a dielectric material such as a polymer plastic whereby the window sash is also an electrically insulated sash. Thus, an electrical potential applied to metal members on the outdoor face of the sash will not be conducted to any of the metal members on the indoor face of the sash.

The window of the present invention is primarily constructed for replacing windows in existing buildings but may also be used for initial installation. As is conventional in the replacement window business, the window is installed from the inside of the building as compared with windows installed from the outside when constructing the building.

It is an object of the present invention to provide a window sash which is thermally insulated with a dead air space between parallel panes of transparent material and a complete thermal insulation between metal members on the indoor face and outdoor face of the sash border.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail wherein like numerals indicate like elements, there is shown in FIG. 1 and elevation view of a window in accordance with the present invention as seen from indoors of a building.

Figure 1:
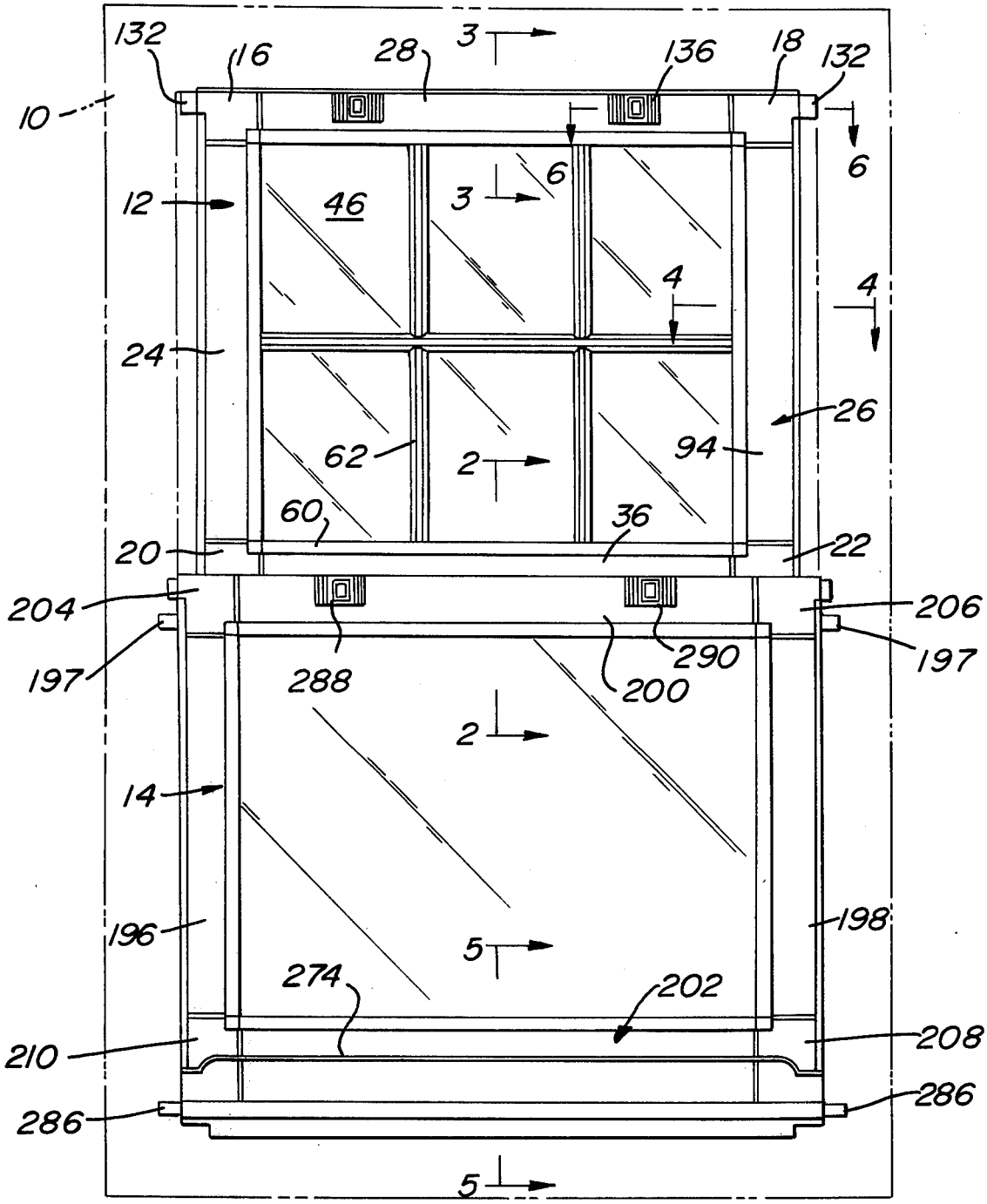
FIG. 1 is a front elevation view of a frame and window sashes in accordance with the present invention as viewed from the indoor face thereof.

A frame 10 movably supports sashes 12 and 14 which are constructed in accordance with the present invention. The upper sash 12 is provided with corner members 16, 18, 20 and 22 of polymeric plastic. The sash 12 is provided with a border defined by the side members 24, 26 interconnected at one end by a top member 28 and at the other end by a bottom member 30. Each of the side members 24, 26 is interconnected with one of the members 28, 30 by way of one of the corner members 16–22.

Figure 2:
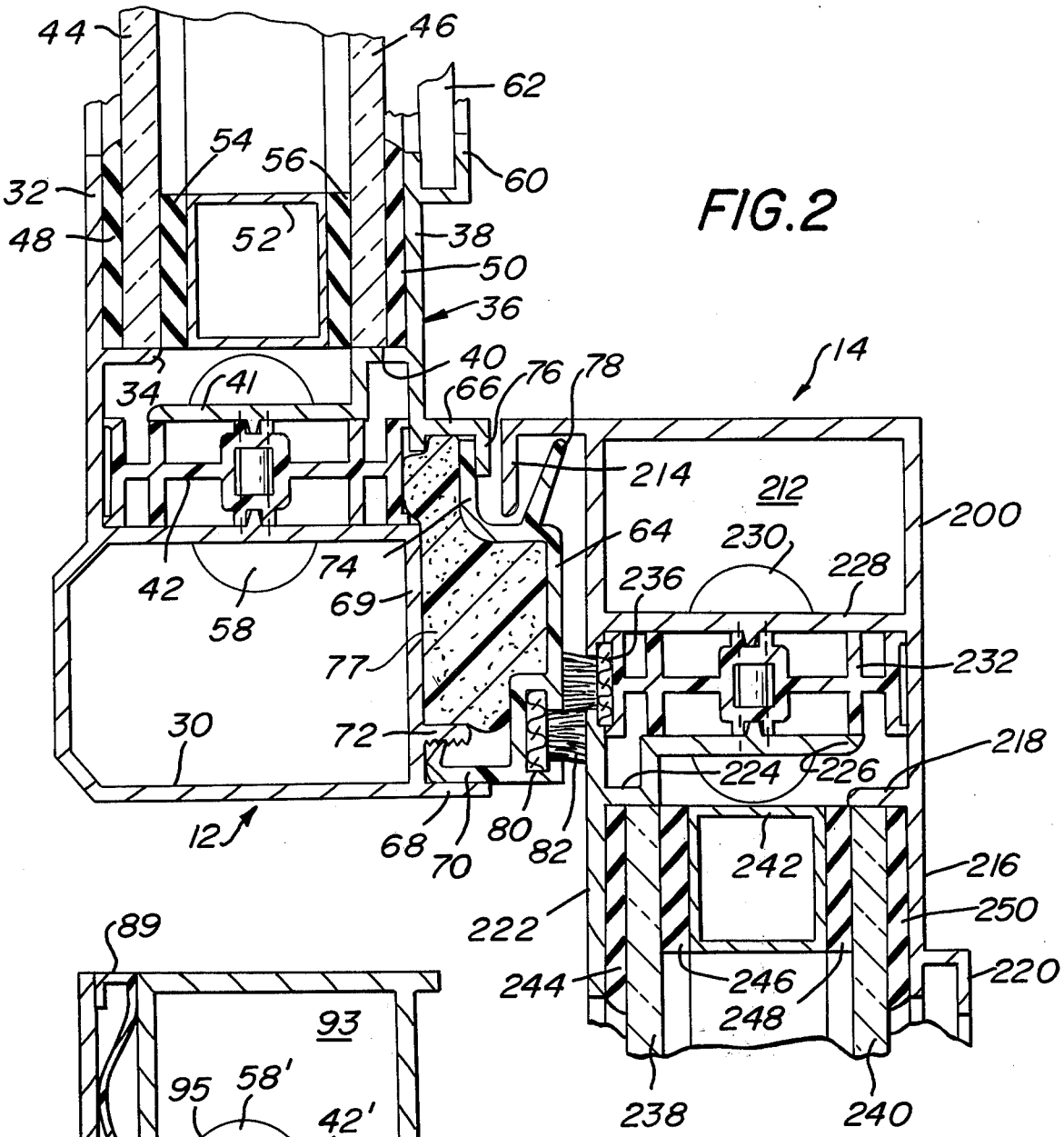
FIG. 2 is a sectional view taken along the line 2—2 in FIG. 1.

Referring to FIG. 2, it will be noted that the preferred construction for the bottom member is in the form of an extrusion of a non-corrusive material such as aluminum. The bottom member 30 includes an upstanding flange 32 on the outdoor face thereof. The flange 32 has an inwardly extending ledge 34. On the indoor face of the sash 12, there is provided a rail member 36 which cooperates with the bottom member 30 and forms a part thereof. The rail member 36 includes an upwardly extending flange 38 and an inwardly extending ledge 40. The ledge 40 is provided with a step 41 which overlies a wall of the bottom member 30. The step 41 of the rail member 36 overlies and is structurally connected to but thermally insulated from the bottom member 30 by way of contact with transversely spaced zones on a thermal barrier strip 42. The step 41 and bottom member 30 are connected together at spaced points therealong by plastic rivets 58 which extend through a hole in strip 42.

The flange 32 on bottom member 30 and the flange 38 on the rail member 36 define a space between which the panes 44, 46 of a transparent material such as glass or polymeric plastic are supported by ledges 34, 40. Pane 44 is spaced from the flange 32 by way of the thermal strip 48. Pane 46 is spaced from the flange 38 by way of the thermal strip 50.

The panes 44, 46 are maintained spaced from one another so as to define a dead air space therebetween by way of a tubular member 52. A barrier strip 54 is provided between pane 44 and the member 52. A similar barrier strip 56 is provided between tubular member 52 and pane 46. The panes 44, 46 correspond in size to the inner periphery of the border of the sash 12. If it is desired to provide the sash 12 with the appearance of having a multiplicity of small panes, sash 12 may be provided with the simulated mullion 62. The simulated mullion 62 has its periphery received within a socket 60 on the upper edge of rail member 36 and the cooperating rail members of the border for frame 12. As illustrated in FIG. 1, the sash 12 has the appearance of being provided with six small panes of transparent material. The mullion 62 is an optional feature and for purposes of illustration, the sash 14 is not provided with a mullion 62.

A thermal barrier strip 64 is positioned between flange 66 on the lower end of rail member 36 and flange 68 on the bottom member 30. See FIG. 2. The strip 64 has one wall 70 releasably and adjustably secured to a serrated flange 72 on wall 69 of the bottom member 30. The end of strip 64 remote from wall 70 has a tongue 74 inside extension 76 of flange 66. Strip 64 has an angularly disposed tongue 78 adjacent tongue 74. A compressable insulator 77 of material such as foam polyurathane occupies the space between strip 64 and wall 69 and is held in place by strip 64.

The strip 64 is preferably extruded so as to have a recess 80. A suitable flexible insulating strip such as felt strip 82 is fixedly secured within the recess 80. The strip 80 is on the indoor face of the sash 12 for cooperation with the sash 14 as will be described hereinafter.

Figure 3:
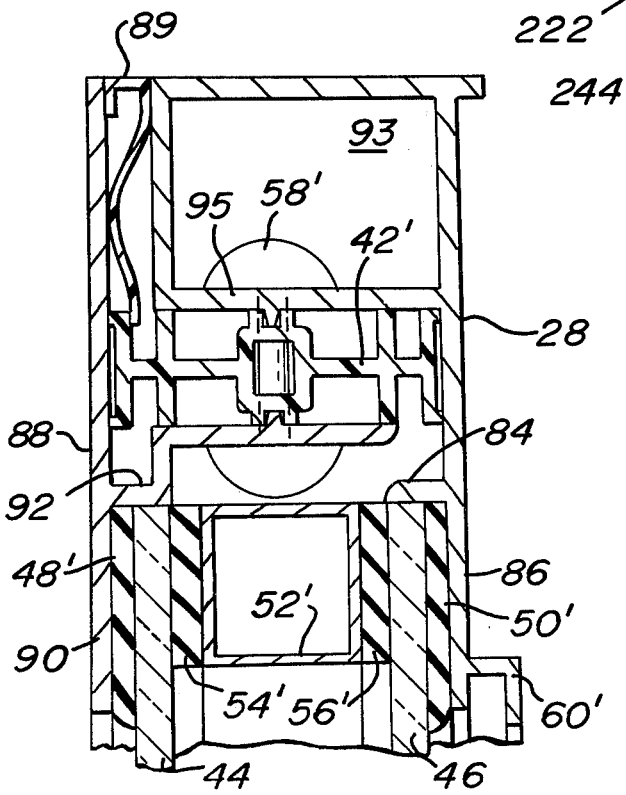
FIG. 3 is a sectional view taken along the line 3—3 in FIG. 1.

The top member 28 of the sash 12 as shown in FIG. 3 and is provided with a rail member 88 comparable to but not identical with the rail member 36. The space between member 88 and 28 is closed by insulator 89. The rail member 88 is on the outdoor face of the sash 12 as shown in FIG. 3. Rail member 88 has a flange 90 which cooperates with the flange 86 on the top member 28. Top member 28 has a ledge 84 extending toward the outdoors from the flange 86. The flanges 86 and 90 embrace the panes 44, 46 which are spaced from one another by elements 52', 54' and 56' which in turn correspond with elements 52, 54 and 56. Pane 44 is spaced from the flange 90 by thermal strip 48'. Pane 46 is spaced from the flange 86 by thermal strip 50'. Wall 95 of the top member 28 overlies and is structurally connected to a step on the rail member 88 by way of plastic rivets 58' with the thermal barrier strip 42' disposed therebetween as described above. Wall 95 is the bottom wall of chamber 93 in member 28.

Figure 4:
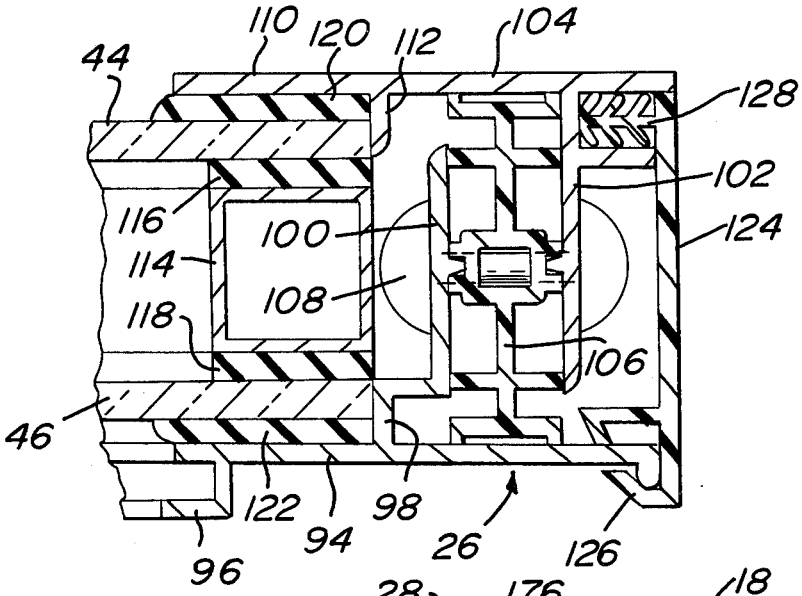
FIG. 4 is a sectional view taken along the line 4—4 in FIG. 1.

As shown in FIG. 3, the top member 28 has a socket 60' for receiving the upper end of the mullion 62. As shown in FIG. 4, the side member 26 includes a rail member 94 having a socket 96 for cooperation with the periphery of the mullion 62 in the same manner as described above in connection with the socket 60. Member 94 has an outwardly directed ledge 98 terminating in a step 100. The step 100 is juxtaposed to and structurally coupled to an inwardly directed wall 102 on the member 104. Wall 102 and member 104 are thermally insulated from the step 100 by way of the thermal barrier strip 106 and are structurally coupled together by way of the plastic rivets 108.

Member 104 has a flange 110 spaced from and parallel to the member 94 and a ledge 112 extending inwardly toward the member 94. A tubular member 114 spaces the panes 44 and 46 apart from one another with the thermal strips 116 and 118 therebetween as shown in FIG. 4.

Pane 44 is spaced from the flange 110 by the thermal strip 120. Pane 46 is spaced from member 94 by the thermal strip 122. A plastic case member 124 is secured to each of metal members 94 and 104. Thus, one edge of member 94 is snapped into a pair of jaws on the case member 124. A prong 128 on the case member 124 is friction fitted into a channel on member 104.

The upper end of the upper sash 12 is capable of being latched to the window frame 10 by a pair of latch assemblies. The latch assemblies are identical. Hence, only the latch assembly associated with the corner member 18 will be described in detail.

Figure 6:
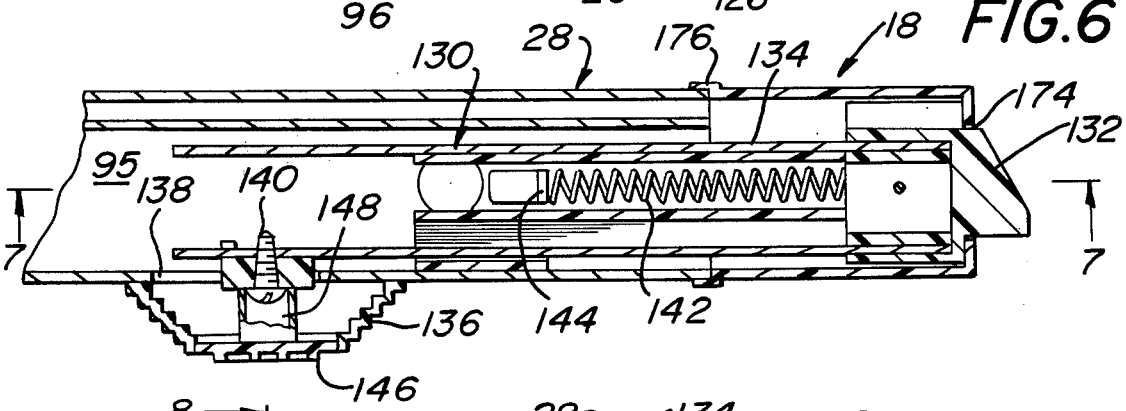
FIG. 6 is a sectional view taken along the line 6—6 in FIG. 1.
Figure 7:
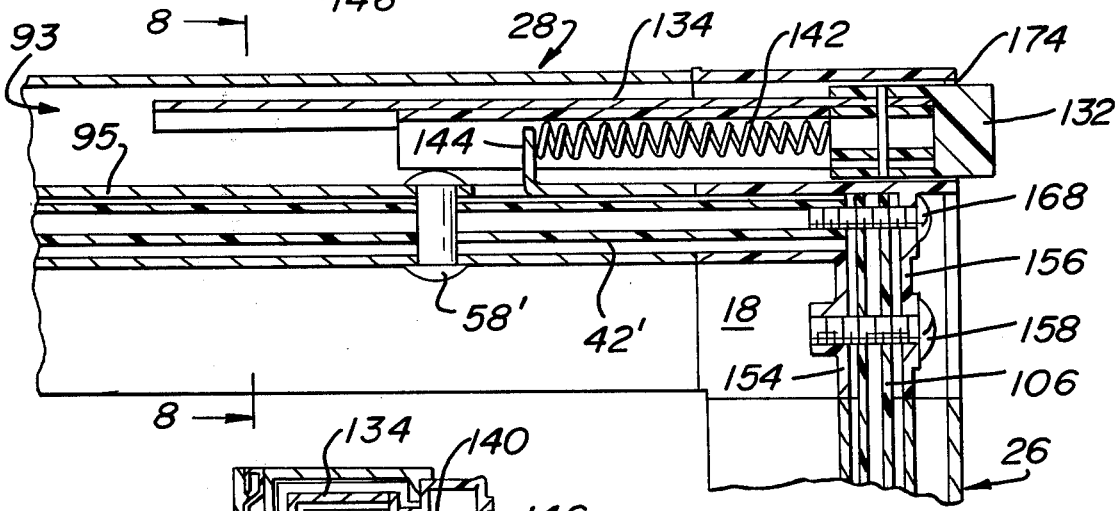
FIG. 7 is a sectional view taken along the line 7—7 in FIG. 6.
Figure 8:
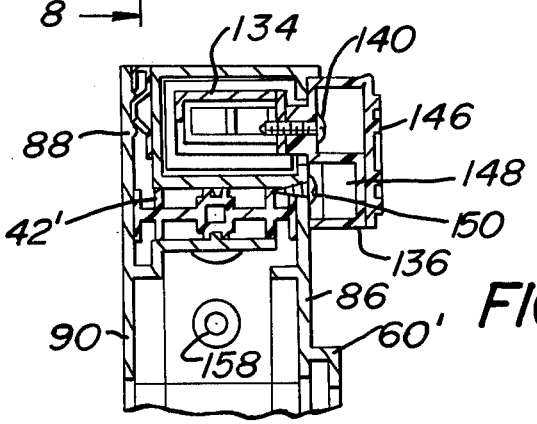
FIG. 8 is a sectional view taken along the line 8—8 in FIG. 7.

In FIGS. 6–8, there is illustrated a latch assembly 130. The latch assembly 130 includes a latch 132 on one end of a carrier 134. Carrier 134 is a channel shaped member open on its lower side as will be apparent from FIG. 8. The latch assembly 130 includes an actuator 136 having a body portion extending through a hole 138 in the top member 28 and secured to a portion of the carrier by way of fastener 140.

An expansion spring 142 extends between the latch 132 and a tab 144. The tab 144 is struck upwardly from the bottom wall 95 of the chamber 93 within the top member 28. As shown in FIG. 6, spring 142 biases the latch assembly 130 to the right until the body portion of the actuator abuts the righthand end of the hole 138.

The actuator 136 is hollow and has stepped side faces. A door 146 is hinged to the actuator 136 along one side edge of the door. The door 146 in its closed position as shown is force-fit into an opening in the actuator 136. See FIGS. 6 and 8. When the door 146 is pivoted to an open disposition, access may be had to the fastener 140 as well as access to fastener 150.

The fastener 150 is threaded to the flange 86 of the top member 28. Opposite the fastener 150, which is located immediately below the fastener 140 in the position of fastener 140 in FIG. 6, there is provided a cavity 148 on the inner surface of the actuator 136. With the door 146 in an open disposition, fastener 150 may be unthreaded so as to cause it to enter the cavity 148 and thereby lock the actuator 136 in a locked position. The presence of the door 146 is not readily ascertainable and hence provides a measure of safety against inadvertent actuation of the latch assembly and/or attempted tampering with the sash in an attempt to manipulate it to an open disposition.

Details with respect to the corner member 18 are shown in FIGS. 6, 7, 9 and 10. Corner member 18 is provided on its lower end with a channel 152 defined by the parallel walls 154 and 156. The thermal barrier strip 106 extends into the channel 152 as shown more clearly in FIG. 7. A fastener 158 extends through hole 160 in wall 156, hole 162 in the strip 106, and through the tapped hole 166 in the boss on wall 154. In this manner, the corner member 18 is connected to the side member 26. Hence, the thermal barrier strip 106 not only structurally connected to the components of side member 26 but also interconnects the side member 26 with the corner member 18.

The thermal barrier strip 106 is provided with a second hole 164 to facilitate coupling of the same to the thermal barrier strip 42' within the top member 28. Wall 156 on the corner member 18 is provided with a second hole 166 adapted to align with the hole 164. A fastener 168 extends through the holes 166 and 164 and is threaded to the barrier strip 42 to thereby interconnect the top member 28 with the corner member 18.

The corner member 18 is provided with spaced discrete channels 170 and 172. See FIG. 9. The barrier strip 42' extends into the channel 170. The latch assembly 130 extends through the channel 172. The corner member 18 has an opening 174 aligned with but narrower than the channel 172 so that the latch 132 may project therethrough as shown in FIG. 6. A flange 176 on the corner member 18 overlies a side face of the top member 28 on the outdoor face of the sash 12. See FIGS. 6 and 9. A similar flange 178 on the corner member 18 overlies a side face of the member 104. Corner member 18 is provided with a cavity 180 open on two sides for receiving the end portion of the sockets 60' and 96 on the indoor face of the sash 12.

Figure 11:
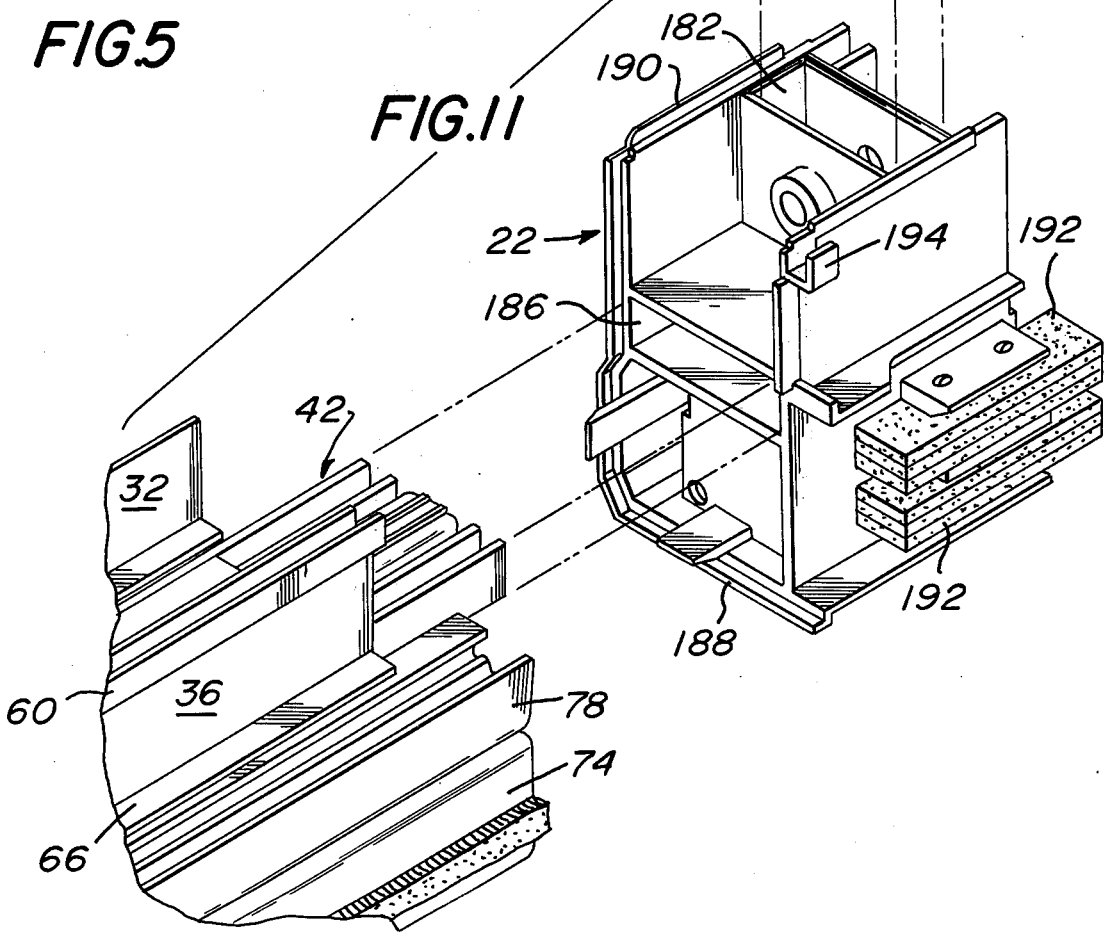
FIG. 11 is a partial perspective exploded view of the lower right corner of the upper sash as shown in FIG. 1.
Figure 9:
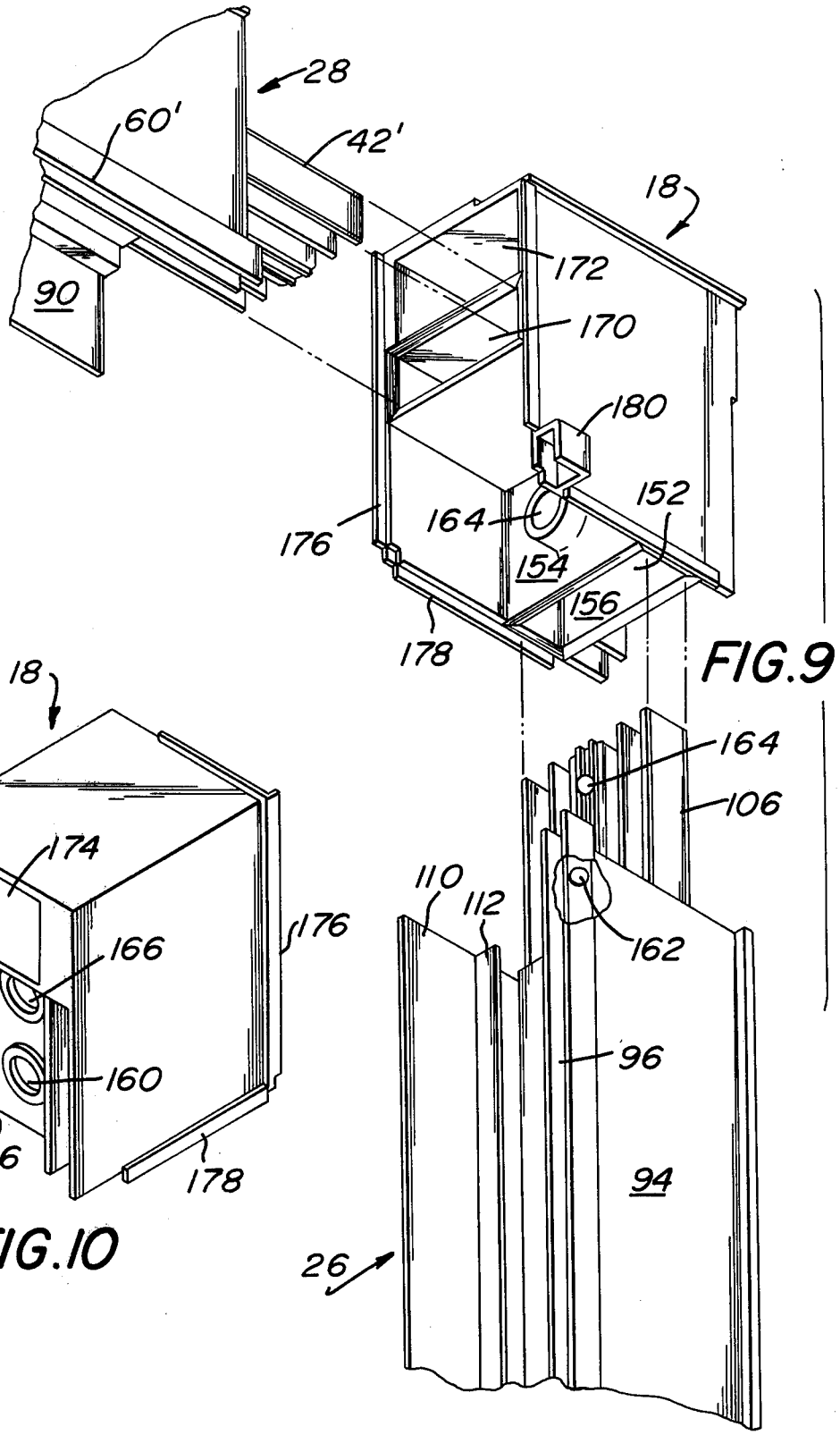
FIG. 9 is an exploded partial perspective view of the upper right corner of the upper sash shown in FIG. 1.
Figure 10:
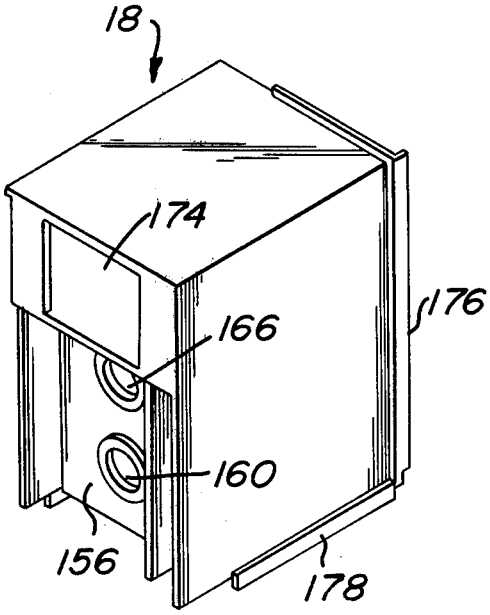
FIG. 10 is a perspective view of the upper right corner of the upper sash as shown in FIG. 1 but when viewed from outdoors.

As shown more clearly in FIG. 11, corner member 22 of the sash 12 is structurally interrelated with the side member 26 and bottom member 30 in substantially the same manner as described above. On its upper surface in FIG. 11, the corner member 22 is provided with a channel 182 for receiving the lower end of the thermal barrier strip 106. The walls defining the channel 182 are provided with aligned openings in the same manner as described above in connection with openings 160 and 164 to receive a fastener comparable to fastener 158. In a similar manner, a fastener will extend through hole 184 and mating holes in the corner member 22 to facilitate joining the thermal barrier strip 106 to the thermal barrier strip 42. The corner member 22 is provided with a channel 186 into which the thermal barrier strip 42 extends.

A flange 188 extends along the bottom and outdoor face of the corner member 22 for overlying the juxtaposed portions of the bottom member 30. A similar flange 190 on the upper edge of corner member 22 overlies member 104 on the side member 26. The corner member 22 is provided with two spaced sets of felt pads 192 which are aligned with and form a continuation of the strip 82. Corner member 22 is provided with a pocket 194 which performs the same function as pocket 180.

Figure 12:
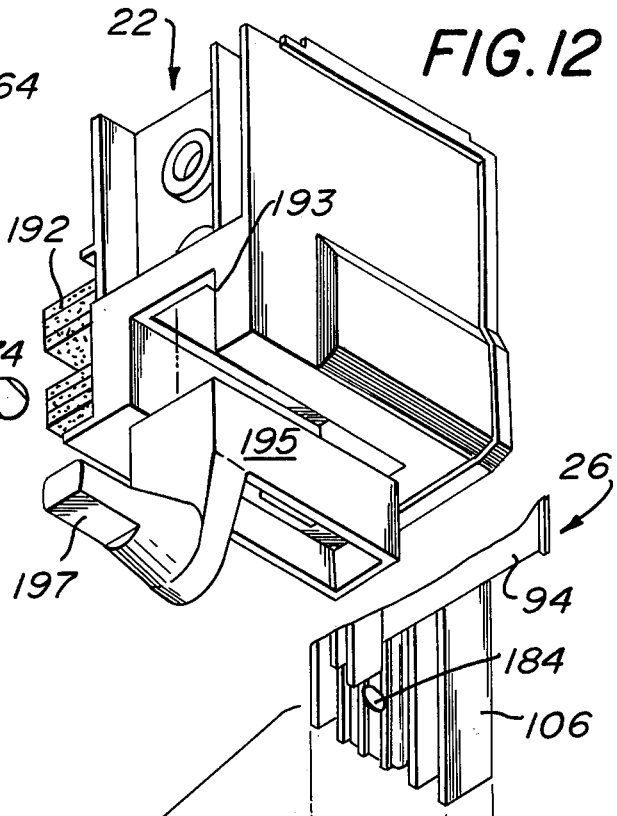
FIG. 12 is a perspective view of the lower right corner member of the upper sash as shown in FIG. 1 but as viewed from outdoors.

As shown in FIG. 12, the corner member 22 has a channel 193 on its bottom surface for receiving a housing 195. Housing 195 is bolted to corner member 22 and has a guide pin 197 projecting therefrom for entry into a track on the frame 10.

Corner member 16 on sash 12 structurally interrelates the side member 24 and top member 28 in the same manner as corner member 18. Likewise, the lower corner member 20 structurally interrelates side member 24 and bottom member 30 in the same manner as corner member 22. Each of the corner members 16 and 18 are identical, except for righthand and lefthand. Each of the corner members 20 and 22 are identical except for righthand and lefthand.

The lower sash 14 is similar to but not identical with the upper sash 12. The differences between the sashes 12 and 14 will be apparent from the following description. The lower sash 14 includes side members 196 and 198 connected at one end by a top member 200 and at their other end by a bottom member 202. The side, top and bottom members of the sash 14 are coupled together by corner members 204, 206, 208, and 210. Referring to FIG. 2, the top member 200 includes a chamber 212. The top member 200 is provided with an extension 214 which extends downwardly between the tongue 74 and 78. The side face of the extension 214 can rub against the tongue 78.

The top member 200 has a flange 216 and an outwardly directed ledge 218. Flange 216 terminates in a downwardly extending socket 220 for selective reception of a mullion. A rail member 222 is disposed opposite the flange 216 and is provided with a ledge 224. Rail member 222 has a step 226 coupled to wall 228 on the top member 200 by way of rivet 230. The rivet 230 extends through the thermal barrier strip 222 disposed between wall 228 and step 226.

The upper edge of the rail member 222 in FIG. 2 is spaced from a juxtaposed edge of the top member 200 to define a gap opposite a recess in the thermal barrier strip 232 which contains a felt strip 236. The strip 236 contacts the strip 64.

Between the rail member 222 and the flange 216, there is provide two panes 238, 240 of transparent material such as glass or plastic separated by a tubular member 242 to define a dead space therebetween. A thermal strip 244 is provided between the rail member 222 and the pane 238. A thermal strip 246 is provided between the pane 238 and the tubular member 242. A thermal strip 248 is provided between the tubular member 242 and the pane 240. A thermal strip 250 is provided between the pane 240 and the flange 216.

Figure 5:
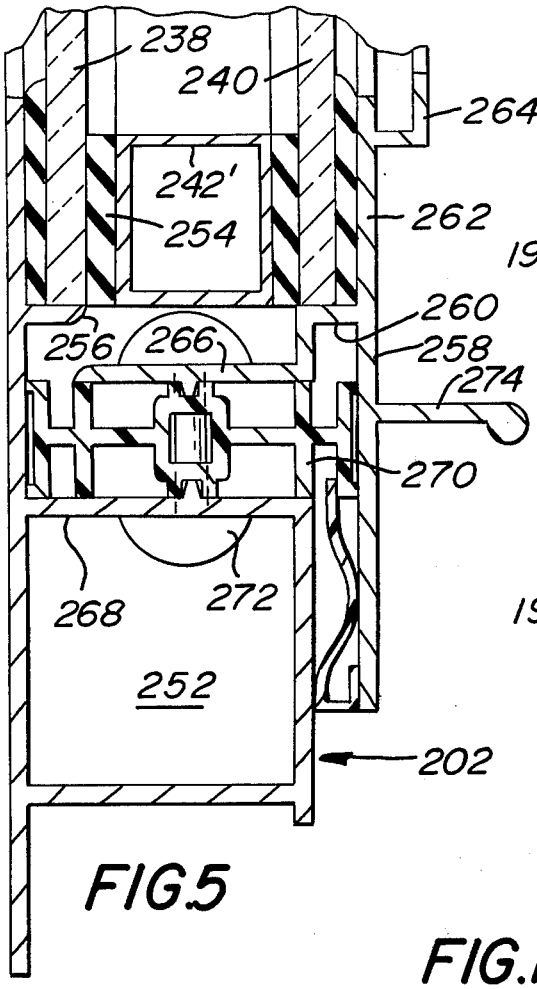
FIG. 5 is a sectional view taken along the line 5—5 in FIG. 1.

As shown in FIG. 5, the bottom member 202 of the sash 14 includes a longitudinally extending chamber 252. The bottom member includes an upstanding flange 254 and an inwardly directed ledge 256. Rail member 262 is on the indoor face of the sash 14 and includes a outwardly directed ledge 260.

The rail 260 has a socket at its upper edge for receiving a mullion. Rail member 262 has a step 266 coupled to a wall 268 at the bottom member 202 by way of plastic rivets 272 at spaced points therealong. A thermal barrier strip 270 is disposed between the wall 268 and the step 266. The rail member 262 has an inwardly directed sill 274.

Each of the thermal barrier strips 42, 42', 106, 232 and 270 are identical in cross section and perform the same function. Further, it will be noted that each of those barrier strips has a width corresponding to the distance across the panes of transparent material and their respective thermal strips. For example, in FIG. 2, the width of the thermal barrier strip 232 is equal to the distance between the rail member 222 and the flange 216. Each barrier strip only has spaced parallel zones of contact with the juxtaposed walls and step of the metal members on the indoor and/or outdoor faces of the sash.

Each of the thermal barrier strips are preferably a rigid, strong polymeric plastic such as polyvinylchloride which can be extruded, will hold tolerances, is a poor heat conductor, and will not absorb more than about 5 percent water. Since these strips are not exposed to sunlight, they need not be UV resistant. The thermal coefficient of conductivity is less than about 0.2.

Figures 13, 14:
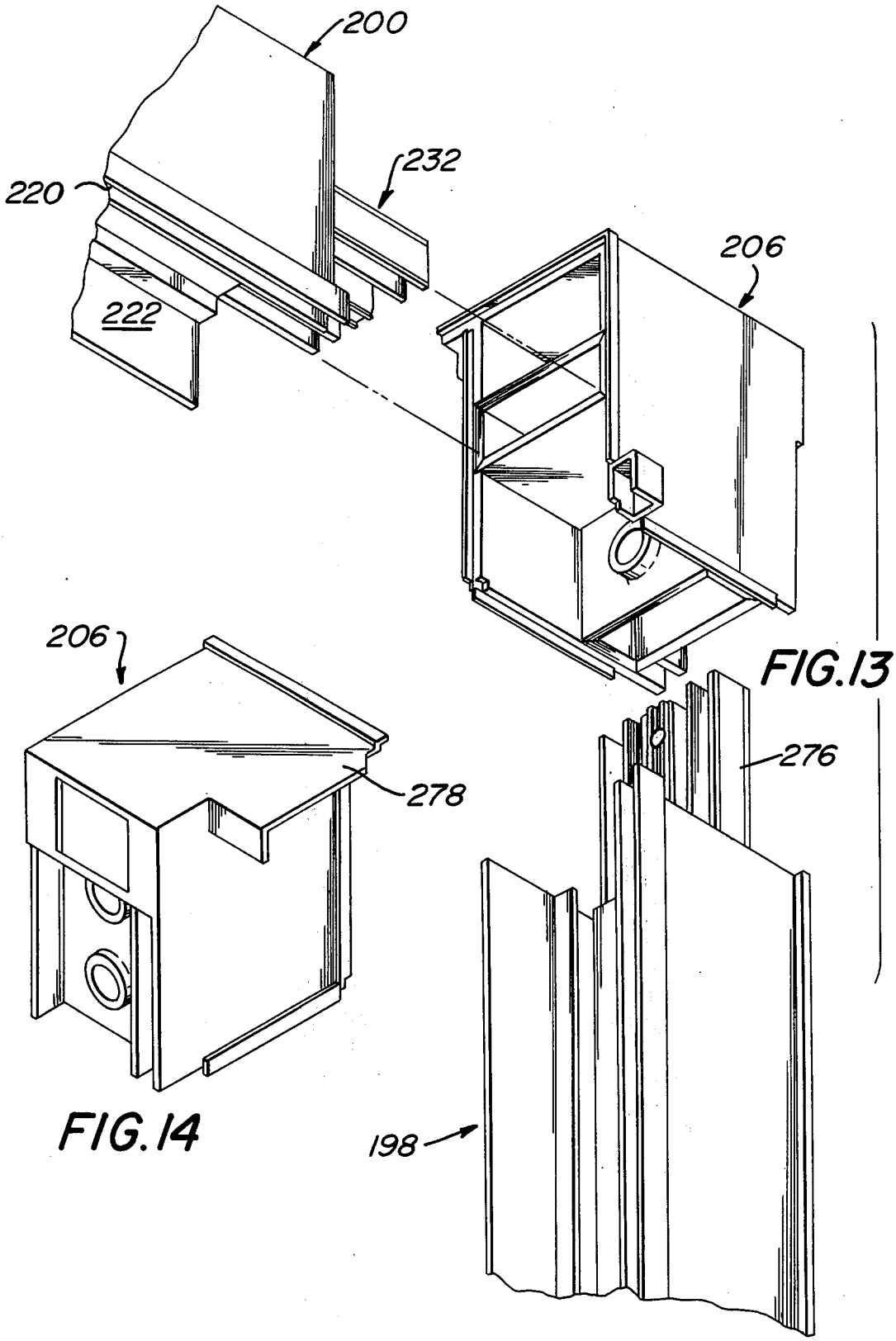
FIG. 13 is an exploded perspective view of the upper right corner of the lower sash shown in FIG. 1.
FIG. 14 is a perspective view of the corner member shown in FIG. 13 but as viewed from the outdoors.

Referring to FIG. 13, it will be seen that the side member 198 and the top member 200 are inner connected with the corner member 206 in a manner similar to that described above and shown in FIG. 9. Corner member 206 is similar to corner member 18 and has channels for receiving the thermal barrier strips 232 and 276 which will be coupled thereto as described above in connection with corner member 18. Further, the corner member 206 has an extension 278 which forms a continuation of the extension 214.

Figures 15, 16:
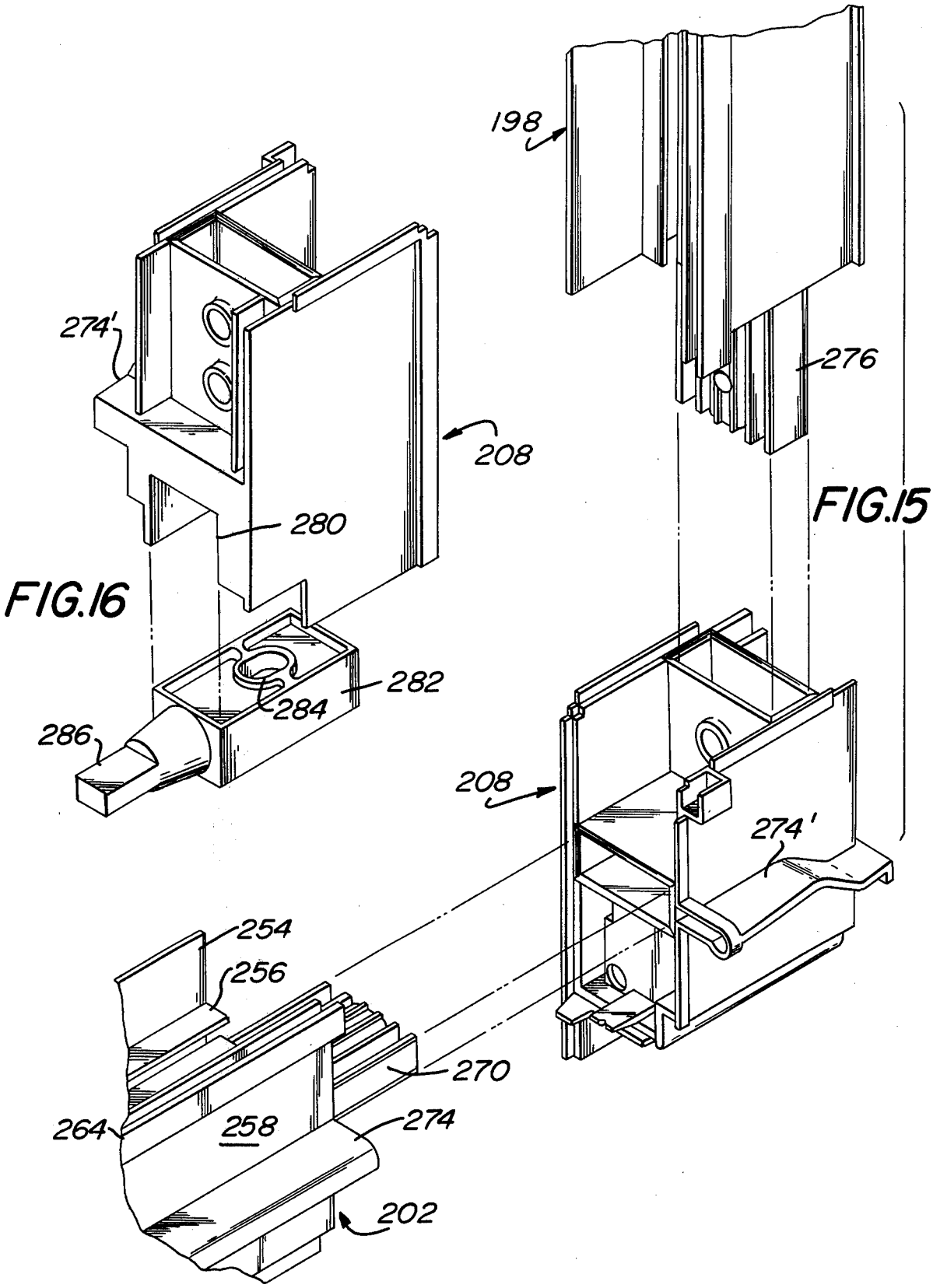
FIG. 15 is an exploded partial perspective view of the lower right corner of the lower sash in FIG. 1.
FIG. 16 is a perspective view of the lower right corner member shown in FIG. 15 but as viewed from the outdoors.

As shown in FIG. 15, the side member 198 and bottom member 202 are coupled together by way of the corner member 208 in the same manner as described above in connection with FIG. 11. The corner member 208 has a sill extension 274' which is aligned with the sill 274.

As shown more clearly in FIG. 16, the corner member 208 is provided with a channel 280 on its bottom surface. The channel 280 receives a housing 282 having a hole 284 to facilitate bolting these elements together. The housing 282 has a guide 286 projecting therefrom for entry into a track on the frame 10.

Except for righthand and lefthand, the corner members 204 and 206 on the lower sash 14 are identical. Likewise, except for righthand and lefthand, the corner members 208 and 210 on the sash 14 are identical.

Each corner member is made from a strong rigid polymeric plastic such as nylon 6-6, and preferably is colored white and UV resistant. Nylon 6-6 can be molded, will hold tolerances, and will not change its characteristics over a wide range of temperatures.

With respect to each of the sashes 12 and 14, it will be noted that the thermal barrier strips structurally couple together the metal members on the indoor and outdoor face of the sashes, thermally and electrically insulate the metal members from one another, while at the same time the thermal barrier strips constitute the means for structurally interconnecting each side member with one of the top and bottom members. Further, it will be noted that none of the fasteners innerconnecting the components of the sash are visible when the sash is installed thereby providing a tamperproof feature.

The lower sash 14 has latch assemblies in the same manner as described above. The actuators for the latch assemblies on the lower sash 14 are designated 288 and 290.

On each of the sashes 12 and 14, there is a latch at each upper corner and a guide at each lower corner. The frame 10 has a track for receiving each guide and latch so that the sashes may be reciprocated with respect to each other and the frame 10. The frame 10 is provided with notches 292 and 296 to facilitate entry of the guides 197 on the corner members 20 and 22, respectively. Also, the frame 10 is provided with notches 294 and 298 to permit entry of the guides 286 on the corner members 210 and 208, respectively.

The present invention may be embodied in other specific forms without departing from the spirit or essential attributes thereof and, accordingly, reference should be made to the appended claims, rather than to the foregoing specification as indicating the scope of the invention.

It is claimed:

1. A window sash comprising a sash border having a pair of side members and a top member and a bottom member, four non-metallic corner members, each corner member being part of said border and innerconnecting one end of a side member with an end of one of said top and bottom members, said sash border supporting two panes of transparent material spaced apart by a dead air space, a thermal barrier strip between the periphery of each pane and a juxtaposed surface of said sash border, said sash border having oppositely disposed major faces, one of which is the indoor face and the other being an outdoor face, said sash border members are metal members on the outdoor face thereof and metal members on the indoor face thereof, the transverse dimension of said corner members being substantially equal to the distance between said major faces, and means including a preformed rigid non-metallic thermal barrier insulating said metal members on the outdoor face from corresponding metal members on the indoor face at spaced parallel zones across the width of juxtaposed portions of said metal members so that there is no direct heat conductive contact between said metal members of said outdoor and indoor faces of said border.

2. A window sash in accordance with claim 1 including a substantially planar side face joining said major faces.

3. A window sash in accordance with claim 1 wherein each of said side members, top member and bottom member has a thermal barrier strip of greater length and projecting from each end thereof, each corner member having at least one channel on mutually perpendicular surfaces thereof for receiving an end portion of a thermal barrier strip on two adjacent members defining said sash border, and fastener means joining each corner member to the two thermal barrier strips received in its channels.

4. A window sash in accordance with claim 1 wherein said bottom member has a tongue of non-metallic material spaced from a flexible deformable barrier on its indoor face thereof for cooperation with a portion of another sash.

5. A window sash in accordance with claim 1 wherein the top member of said sash has an extension on its outdoor face thereof for cooperation with a non-metallic thermal barrier on another sash.

6. A window sash in accordance with claim 1 wherein said border on its indoor face thereof is provided with means for receiving and supporting a mullion parallel to but spaced from one of said panes so that said one pane appears to be a plurality of discrete panes side by side.

7. A window sash in accordance with claim 1 wherein a thermal barrier strip on a side member is connected to a thermal barrier strip on said bottom member by way of fasteners extending between said barrier strips and one of said corner members whereby the barrier strips also constitute a part of the means of structurally interconnecting the bottom member of the sash border with a side member of the sash border.

8. A window sash in accordance with claim 1 wherein each of the corner members at opposite ends of said bottom member is provided with a guide pin extending outwardly beyond the side faces of the corner members.

9. A window sash in accordance with claim 8 wherein said top member of said sash border supports a pair of latch assemblies, each latch assembly including a latch extending from each upper corner member beyond the side face thereof.

10. A window sash in accordance with claim 9 wherein each latch assembly includes an actuator having a movable door thereon to facilitate access to an adjustable lock means for locking each actuator in a predetermined position on its top member to thereby prevent relative movement between each latch actuator and said top member.

11. A window sash comprising a sash border having parallel side members, said border including a top member and a bottom member, said border including four corner members of a rigid non-metallic material having a low coefficient of thermal conductivity, each end of each side member being coupled to one of said top and bottom members by way of a corner member, each of said top, bottom and side members of said border is a metal member on an indoor face thereof and a metal member on an outdoor face thereof insulated from direct conductive contact with one another by way of a rigid non-metallic thermal barrier, each thermal barrier being longer than its associated border member, and means securing each corner member to an exposed end portion of a thermal barrier on the two border members associated therewith, and said border supporting at least one pane of transparent material.

12. A windowsash in accordance with claim 11 wherein mechanical fasteners of non-metallic material extend through each thermal barrier and juxtaposed surfaces on the border member associated therewith, each of said mechanical fasteners being disposed entirely between and generally parallel to said indoor and outdoor faces.

13. A window sash in accordance with claim 11 wherein each thermal barrier strip is in contact with the metal members on the indoor and outdoor faces of said sash border along the length of the metal members at spaced zones transversely across the faces of the sash border.

14. A window sash in accordance with claim 13 wherein said barrier strip acts as a spacer between the metal members to maintain the metal members a spaced distance apart in a direction across the width of the border.

15. A window sash in accordance with claim 1 wherein each member of said sash border includes a rail member on one of said faces, said rail member having a step parallel to but spaced from a wall integral with a metal member on an opposite face and spaced therefrom by a thermal barrier strip, and non-metallic fasteners extending between said wall and step through the thermal barrier strip, said fasteners being generally parallel to said faces.

16. A window sash in accordance with claim 15 wherein said step and said wall are perpendicular to the plane of the major face of said transparent panes and said non-metallic fasteners are parallel to said plane.

17. A window sash in accordance with claim 1 wherein said thermal barrier extends between and contacts parallel transversely extending juxtaposed portions of the metal member on said outdoor face and the corresponding metal member on the indoor face.

18. A window sash in accordance with claim 17 wherein the length of the distance the thermal barrier contacts the metal members is greater than the distance between the two panes of transparent material.

* * * * *